US005780419A

United States Patent [19]

Doumen et al.

[11] Patent Number: 5,780,419

[45] Date of Patent: Jul. 14, 1998

[54] DETERGENT POWDER COMPOSITIONS COMPRISING METAL ION-CHELANT COMPLEX AND ANIONIC FUNCTIONAL POLYMER

[75] Inventors: Achille Jules Edmond Doumen, Merchtem; Luc Goovaerts, Haacht; Jose Luis Vega, Strombeek-Bever, all of Belgium

[73] Assignee: The Procter & Gamble Company, Cincinnati, Ohio

[21] Appl. No.: 722,090

[22] PCT Filed: Apr. 20, 1995

[86] PCT No.: PCT/US95/04799

§ 371 Date: Oct. 18, 1996

§ 102(e) Date: Oct. 18, 1996

[87] PCT Pub. No.: WO95/29216

PCT Pub. Date: Nov. 2, 1995

[30] Foreign Application Priority Data

Apr. 20, 1994 [EP] European Pat. Off. ..... 94201092

[51] Int. Cl.[6] ..... C11D 17/06; C11D 3/37; C11D 3/60; C11D 10/02

[52] U.S. Cl. ..... 510/452; 510/348; 510/361; 510/443; 510/476; 510/469; 510/477; 510/480; 510/504

[58] Field of Search ..... 510/476, 361, 510/533, 311, 348, 376, 438, 443, 444, 445, 452, 469, 477, 480, 504

[56] References Cited

U.S. PATENT DOCUMENTS

| | | | |
|---|---|---|---|
| 4,259,200 | 3/1981 | Sims et al. | 252/102 |
| 4,384,970 | 5/1983 | Tourdot et al. | 252/99 |
| 4,502,986 | 3/1985 | Robson | 8/137 |
| 4,614,646 | 9/1986 | Christiansen | 423/272 |
| 4,959,409 | 9/1990 | Heinzman et al. | 525/61 |
| 5,318,728 | 6/1994 | Surutzidis et al. | 252/548 |
| 5,366,652 | 11/1994 | Capeci et al. | 510/444 |
| 5,433,881 | 7/1995 | Townend et al. | 510/313 |
| 5,486,303 | 1/1996 | Capeci et al. | 510/444 |
| 5,494,599 | 2/1996 | Goovaerts et al. | 510/443 |

*Primary Examiner*—Ardith Hertzog

*Attorney, Agent, or Firm*—Ken K. Patel; Kim W. Zerby; Jacobus C. Rasser

[57] ABSTRACT

A free-flowing detergent powder is prepared by spray drying and comprises from 10% to 90%, by weight, of a complex of a chelating agent and a metal ion selected from the group consisting of magnesium, calcium, strontium, zinc, aluminum and mixtures thereof, and from 10% to 90%, by weight, of a polymer comprising anionic functional groups. The detergent powder comprises less than 20%, by weight, on an anhydrous basis, of inorganic components other than the metal ion.

20 Claims, No Drawings

DETERGENT POWDER COMPOSITIONS COMPRISING METAL ION-CHELANT COMPLEX AND ANIONIC FUNCTIONAL POLYMER

The present invention relates to detergent powders which essentially comprise a complexed chelating agent and an anionic polymer. The powders may be readily prepared by spray drying.

Detergent components and compositions have been made using various spray drying techniques for many years. Typically various detergent active materials are dissolved or dispersed in an aqueous solution which is then pumped under high pressure to an atomiser, such as a nozzle or a spinning disc.

Excess water is then removed from the atomised droplets by a drying gas, usually hot air. The dried droplets then form a free-flowing granular product. Most granular products prepared in this way comprise both organic and inorganic materials. One prior art disclosure of a detergent component in which the principle detergent active material is a complexed chelating agent is:

U.S. Pat. No. 4,259,200, issued on Mar. 31st, 1981 discloses complexes of chelating agent with metal ions. The complexes are said to have improved chemical stability in bleaching compositions. Various methods of obtaining a particulate product which comprises the metal/chelating agent complexes are also disclosed, including spray-drying, by including inorganic salts such as tetraborate, triphosphate, sulphate.

In fact, chelating agents are frequently precomplexed with magnesium in order to protect them from degradation in the presence of bleach. However molar ratios of magnesium: chelating agent of greater than 3:1 are difficult to prepare due to precipitation from aqueous solution. Precipitation in a spray drying process rapidly leads to blockage of the nozzle. Furthermore, powders which essentially consist of chelating agent/magnesium complex have a very low rate of solubility.

It has now been found that the addition of various polymers which comprise anionic functional groups avoids the precipitation problem, allows higher molar ratios of chelating agent to magnesium to be prepared by spray drying, and greatly increases the rate of solubility of the resulting powder.

The addition of anionic polymer also enables powders to be prepared which have a very high organic content, preferably greater than 80%. Such powders which are difficult to prepare by other means, provide a convenient method for handling and processing organic polymers.

SUMMARY OF THE INVENTION

The present invention relates to free-flowing detergent powder which is prepared by spray drying, the powder comprising:

(a) from 10% to 90% by weight of a complex, said complex comprising
  (a)(i) a chelating agent and
  (a)(ii) a metal ion selected from the group consisting of magnesium, calcium, strontium, zinc and aluminium, and mixtures thereof, characterised in that the powder further comprises (b) from 10% to 90% by weight of a polymer, said polymer comprising functional groups which are anionic.

Preferably the powder comprises less than 20%, more preferably less than 10% by weight (on anhydrous basis), of inorganic components other than the metal ion (a)(ii). Most preferably the total level of aluminosilicate and carbonate (on anhydrous basis) is less than 10% by weight.

The chelating agent is preferably selected from the group consisting of phosphonic acid, succinic acid, the salts of phosphonic or succinic acid, or mixtures thereof, even more preferred chelating agents are diethylene triamine penta (methylene phosphonic acid), or ethylenediamine-N-N'-disuccinic acid, or their salts, or mixtures thereof. The preferred metal ion is magnesium. The molar ratio of the metal ion to the chelating agent is preferably greater than 3:1.

The polymer may comprise carboxylate functional groups, especially the water-soluble salts of homo-and copolymers of aliphatic carboxylic acids such as acrylic acid, maleic acid, vinylic acid, itaconic acid, mesaconic acid, fumaric acid, aconitic acid, citraconic acid, methylenemalonic acid and mixtures thereof.

A preferred polymer is a copolymer of maleic and acrylic acid having a molecular weight of from 2000 to 100 000.

Optionally the free-flowing detergent powder may also comprise a cationic surfactant. Where present the cationic surfactant may be present at from 1% to 80% by weight, from 2% to 20% by weight of dimethyl ethoxy ammonium chloride being preferred.

DETAILED DESCRIPTION OF THE INVENTION

The essential components of the present invention are a chelating agent and a polymer comprising anionic functional groups. Examples of these will now be given in more detail.

Chelating Agents

The chelating agents suitable for use in the present invention can be chosen from a wide range of chemicals which are known to the man skilled in the art. Examples of suitable chelating agents are phosphonic and succinic acids and their salts.

The polyphosphonates are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Examples of particularly suitable chelating agents are ethylene diamine tetra (methylene phosphonic acid) and diethylene triamine penta (methylene phosphonic acid).

Another preferred chelating agent is ethylenediamine-N, N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include NaEDDS, $Na_2$EDDS and $Na_4$EDDS. Examples of such preferred magnesium salts of EDDS include Mg EDDS and $Mg_2$EDDS. The magnesium salts are the most preferred for inclusion in compositions in accordance with the invention. The structure of the acid form of EDDS is as follows:

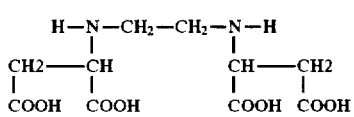

EDDS can be synthesised, for example, from readily available, inexpensive starting material such as maleic anhydride and ethylene diamine as follows:

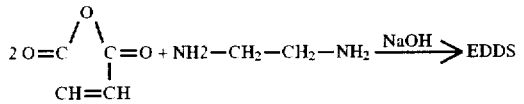

A more complete disclosure of methods for synthesising EDDS from commercially available starting materials can be found in U.S. Pat. No. 3,158,635, Kezerian and Ramsay, issued Nov. 24, 1964.

The synthesis of EDDS from maleic anhydride and ethylene diamine yields a mixture of three optical isomers, [R,R],[S,S], and [S,R], due to the two asymmetric carbon atoms. The biodegradation of EDDS is optical isomerspecific, with the [S,S] isomer degrading most rapidly and extensively, and for this reason the [S,S] isomer is most preferred for inclusion in the compositions of the invention.

The [S,S] isomer of EDDS can be synthesised from L-aspartic acid and 1,2-dibromoethane, as follows:

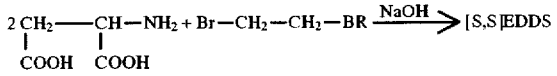

A more complete disclosure of the reaction of L-aspartic acid with 1,2-dibromoethane to form the [S,S] isomer of EDDS can be found in Neal and Rose, Stereospecific Ligands and Their Complexes of Ethylenediaminediscuccinic Acid, *Inorganic Chemistry*, Vol 7 (1968), pp. 2405–2412.

Specific examples of carboxylates and other chelanting agents which are suitable for use in the present invention are given below.

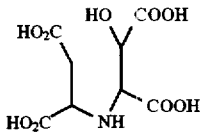

Iminodiacetic acid—N-2-Hydroxypropyl sulphonic acid

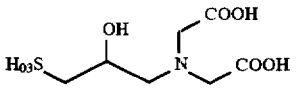

Aspartic acid, Ncarboxymethyl N-2 Hydroxypropyl 3 sulphonic acid.

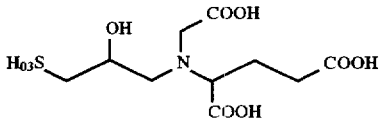

βAlanine N,N Diacetic acid

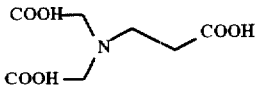

Aspartic acid—N,N Diacetic acid

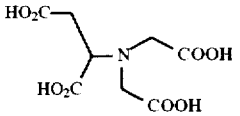

Aspartic acid N-Monoacetic acid

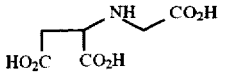

Iminodisuccinic acid

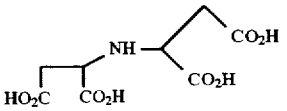

Amino acid based chelanting agents such as

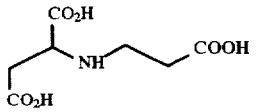

Iso serine di acetic acid (ISDA)

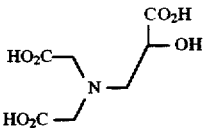

2-Phosphonobutane-1,2-4-tricarboxylic acid

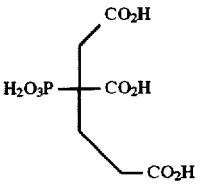

GADS

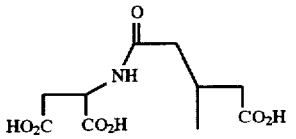

Also useful as chelanting agents are:

Alkyl iminodiacetic acid; dipicolinic acid; hydroxy-1,1-ethylidene diphosphonic acid (HEDP) and derivatives.

Polymers and/or Co-polymers

The polymers and co-polymers of the present invention may be chosen from a wide range of organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyacrylates, polyaspartates and various copolymers, such as those of maleic and acrylic acids. Molecular weights for such polymers vary widely but most are within the range of 2,000 to 100,000.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Most preferred for use in the present invention are copolymers of maleic and acrylic acid having a molecular weight of from 2000 to 100000, carboxymethyl cellulose and mixtures thereof.

Optional ingredients in the spray dried powder of the present invention are cationic surfactants. Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$ is $C_1$ to $C_{20}$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride, $C_{12-14}$ alkyl dimethyl ethoxy ammonium chloride and $C_{12-14}$ alkyl trimethyl ammonium methosulfate.

Processing

An essential step of the process of making the spray-dried powder of the present invention is the preparation of the complex of the chelating agent with the metal ion. Preferably this is done by dissolving a salt of the metal ion into a solution of the chelating agent in the required ratios. The molar ratio of metal ion to chelating agent is preferably at least 1:1, the present invention allows molar ratios of greater than 3:1 to be prepared, most preferred is a molar ratio of about 5:1. Whilst any metal salt may be used, magnesium sulphate is most preferred.

The anionic polymer is added to the solution comprising the complex together with any other optional ingredients. The resulting slurry or solution is then spray dried by conventional means.

The most preferred method for spray drying is the use of spinning disc atomiser.

Manufacture of Finished Detergent Compositions

In the most simple embodiment of the present invention, the free-flowing spray-dried powder is admixed with other detergent powders to form a finished granular detergent product. It is an important advantage of the present invention that the spray-dried powder dissolves rapidly in water to release the chelating agent and polymer as early as possible into the washing process. Components of the finished detergent composition may be chosen from a very wide range of detergent active materials. Common examples include surfactants, builders, bleach, bleach activator, enzymes, optical brighteners, soil release polymers, dye transfer inhibiting agents, softening clay, perfume, etc.

Alternatively the spray-dried powder of the present invention may be further processed, for example by additional granulation, agglomeration, compaction steps. A particularly preferred process is described in EP 508543, published on 14th Oct., 1992. In this application a process is disclosed for structuring or "conditioning" a high active surfactant paste and then granulating in the presence of detergent powder. It is foreseen that the spray-dried powder may be a component either of the conditioning step, or of the granulation step, or of both steps. Using this process in combination with the spray-dried powder of the present invention enables free-flowing detergent granulates to be produced having a surfactant content of at least 40% by weight, and a bulk density of at least 600 g/l.

EXAMPLES (all % are by weight)

Example 1

The following free-flowing powder composition was prepared:

| | |
|---|---|
| Acrylic/Maleic copolymer (MW = 50000) | 72% |
| Diethylenetriaminepenta (methylene phosphonic acid) | 10% |
| MgSO4 | 10% |
| Water | 8% |
| | 100% |

The composition was prepared by mixing a 40% active solution of the sodium salt of the copolymer, a 25% active solution of the phosphonic acid and the sulphate powder (MgSO4.7H2O) to give a slurry.

The slurry was then processed through a continuous spray dryer with co-current air inlet and a rotating disc (15000 rpm) at the top of the tower. After the exit from the bottom of the tower, two fluid beds in series provide further drying and cooling of the spray dried product.

After classification (removal of fines and oversize particles) by vibrating screens, the resulting spray dried powder had a bulk density of 450 g/l (measured by the repour cup method).

Example 2

The following free-flowing powder composition was prepared by the same process as in example 1, except that diethylenetriaminepenta (methylene phosphonic acid) was replaced by ethylenediamine—N,N—disuccinic acid used as a 33% active solution:

| | |
|---|---|
| Acrylic/Maleic copolymer (MW = 50000) | 43.5% |
| Ethylenediamine-N,N-Disuccinic Acid | 15.5% |
| MgSO4 | 31.0% |
| Water | 10.0% |
| | 100% |

The resulting powder is free flowing and has a bulk density of 460 g/l.

Example 3

The following free-flowing powder composition was prepared by the same process as in example 1:

| | |
|---|---|
| Acrylic/Maleic copolymer (MW = 50000) | 42.0% |
| Ethylenediamine-N,N-Disuccinic Acid | 24.5% |
| MgSO4 | 24.5% |
| Water | 9.0% |
| | 100% |

The resulting powder is free flowing and has a bulk density of 450 g/L.

Example 4

The following free-flowing powder composition was prepared by the same process as in example 1:

| | |
|---|---|
| Acrylic/Maleic copolymer (MW = 50000) | 62.0% |
| Ethylenediamine-N,N-Disuccinic Acid | 14.0% |
| MgSO4 | 14.0% |
| Water | 10.0% |
| | 100% |

The resulting powder is free flowing and has a bulk density of 430 g/L.

We claim:

1. A free-flowing detergent powder prepared by spray drying, comprising (a) from 10% to 90%, by weight, of a complex of a chelating agent and a metal ion selected from the group consisting of magnesium, calcium, strontium, zinc, aluminum and mixtures thereof, and (b) from 10% to 90%, by weight, of a polymer comprising anionic functional groups, wherein the detergent powder comprises less than 20%, by weight, on an anhydrous basis, of inorganic components other than the metal ion.

2. A free-flowing detergent powder according to claim 1, wherein the chelating agent is selected from the group consisting of phosphonic acid, succinic acid, salts of phosphonic, salts of succinic acid, and mixtures thereof, and further wherein the metal ion is magnesium.

3. A free-flowing detergent powder according to claim 2, wherein the chelating agent is selected from the group consisting of diethylene triamine penta (methylene phosphonic acid), ethylenediamine-N-N'-disuccinic acid, their salts, and mixtures thereof.

4. A free-flowing detergent powder according to claim 1, wherein the polymer (b) comprises carboxylate functional groups.

5. A free-flowing detergent powder according to claim 4, wherein the polymer (b) is selected from the group consisting of water-soluble salts of homopolymers and copolymers of acrylic acid, maleic acid, vinylic acid, itaconic acid, mesaconic acid, fumaric acid, aconitic acid, citraconic acid, methylenemalonic acid, and mixtures thereof.

6. A free-flowing detergent powder according to claim 5, wherein the polymer (b) is a copolymer of maleic acid and acrylic acid and has a molecular weight of from 2000 to 100,000.

7. A free-flowing detergent powder according to claim 1, wherein the detergent powder comprises less than 10%, by weight, on anhydrous basis, of inorganic components other than the metal ion.

8. A free-flowing detergent powder according to claim 1, wherein the detergent powder comprises less than 10%, by weight, on anhydrous basis, of aluminosilicate and carbonate.

9. A free-flowing detergent powder according to claim 1, wherein the molar ratio of the metal ion to the chelating agent is greater than 3:1.

10. A free-flowing detergent powder according to claim 1, further comprising from 1% to 80%, by weight, of a cationic surfactant.

11. A free-flowing detergent powder according to claim 10, comprising from 2% to 20%, by weight, of dimethyl ethoxy ammonium chloride.

12. A free-flowing detergent powder prepared by spray drying, comprising (a) from 10% to 90%, by weight, of a complex of a chelating agent and a metal ion selected from the group consisting of magnesium, calcium, strontium, zinc, aluminum and mixtures thereof, the molar ratio of the metal ion to the chelating agent in the complex being greater than 3:1, and (b) from 10% to 90%, by weight, of a polymer comprising anionic functional groups, wherein the detergent powder comprises less than 20%, by weight, on an anhydrous basis, of inorganic components other than the metal ion.

13. A free-flowing detergent powder according to claim 12, wherein the chelating agent is selected from the group consisting of diethylene triamine penta (methylene phosphonic acid), ethylenediamine-N-N'-disuccinic acid, their salts, and mixtures thereof.

14. A free-flowing detergent powder according to claim 12, wherein the polymer (b) is selected from the group consisting of water-soluble salts of homopolymers and copolymers of acrylic acid, maleic acid, vinylic acid, itaconic acid, mesaconic acid, fumaric acid, aconitic acid, citraconic acid, methylenemalonic acid, and mixtures thereof.

15. A free-flowing detergent powder according to claim 12, wherein the detergent powder comprises less than 10%, by weight, on anhydrous basis, of inorganic components other than the metal ion.

16. A free-flowing detergent powder according to claim 12, wherein the detergent powder comprises less than 10%, by weight, on anhydrous basis, of aluminosilicate and carbonate.

17. A free-flowing detergent composition according to claim 12, further comprising from 2% to 20%, by weight, water soluble quaternary cationic surfactant of the formula $R_4R_5R_6R_7N^+X^-$ wherein $R_4$ is alkyl having from 10 to 20 carbon atoms, $R_5$ is $C_1$ to $C_{20}$, and $R_6$ and $R_7$ are each $C_1$ to $C_7$ alkyl, and $X^-$ is an anion.

18. A free-flowing detergent powder according to claim 12, further comprising from 2% to 20%, by weight, of dimethyl ethoxy ammonium chloride.

19. A free-flowing detergent powder prepared by spray drying, comprising (a) from 10% to 90%, by weight, of a complex of a chelating agent, and a metal ion selected from the group consisting of magnesium, calcium, strontium, zinc, aluminum and mixtures thereof, the molar ratio of the metal ion to the chelating agent in the complex being greater than 3:1, and (b) from 10% to 90%, by weight, of a polymer comprising anionic functional groups, wherein the detergent powder comprises less than 20%, by weight, on an anhydrous basis, of inorganic components other than the metal ion and less than 10%, by weight, on an anhydrous basis, of aluminosilicate and carbonate.

20. A free-flowing detergent powder according to claim 19, wherein the chelating agent is selected from the group consisting of phosphonic acid, succinic acid, salts of phosphonic acid, salts of succinic acid, and mixtures thereof, the metal ion is magnesium, and the polymer (b) is selected from the group consisting of homopolymers and copolymers of acrylic acid, maleic acid, vinylic acid, itaconic acid, mesaconic acid, fumaric acid, aconitic acid, citraconic acid, methylenemalonic acid, and mixtures thereof.

* * * * *